US006674032B2

(12) United States Patent
Pfenninger et al.

(10) Patent No.: US 6,674,032 B2
(45) Date of Patent: Jan. 6, 2004

(54) MANUAL CALL POINT

(75) Inventors: Christoph Pfenninger, Rapperswil (CH); Heinz Diener, Zurich (CH)

(73) Assignee: Siemens Building Technologies AG (CH)

( * ) Notice: Subject to any disclaimer, the term of this patent is extended or adjusted under 35 U.S.C. 154(b) by 0 days.

(21) Appl. No.: 10/232,002

(22) Filed: Aug. 29, 2002

(65) Prior Publication Data

US 2003/0076216 A1 Apr. 24, 2003

(30) Foreign Application Priority Data

Sep. 3, 2001 (EP) ..... 01121050

(51) Int. Cl.[7] ..... H01H 3/16; G08B 25/12

(52) U.S. Cl. ..... 200/300; 200/61.62; 340/303; 337/1

(58) Field of Search ..... 337/401, 1, 2, 337/299, 402, 417; 200/61.62, 300; 340/303

(56) References Cited

U.S. PATENT DOCUMENTS

| | | | | | |
|---|---|---|---|---|---|
| 2,029,373 | A | * | 2/1936 | Horni | 340/303 |
| 2,083,324 | A | * | 6/1937 | Edwards | 340/303 |
| 2,545,854 | A | * | 3/1951 | Levy | 200/300 |
| 2,553,244 | A | * | 5/1951 | Ellmann | 340/303 |
| 2,570,823 | A | * | 10/1951 | Levy | 337/404 |
| 2,594,369 | A | * | 4/1952 | Verkuil et al. | 340/307 |
| 2,632,070 | A | * | 3/1953 | Verkuil | 200/52 R |
| 2,726,381 | A | * | 12/1955 | Verkuil | 340/308 |
| 2,822,451 | A | * | 2/1958 | Holmes | 200/300 |
| 2,830,143 | A | * | 4/1958 | Koopman | 200/43.01 |
| 2,985,741 | A | * | 5/1961 | Ellmann | 200/300 |
| 3,143,611 | A | * | 8/1964 | Nansel | 200/61.62 |
| 3,183,501 | A | * | 5/1965 | Seaton | 340/296 |
| 3,253,272 | A | * | 5/1966 | Schuchard et al. | 340/307 |
| 3,297,853 | A | * | 1/1967 | Schmiedel et al. | 200/300 |
| 3,356,801 | A | * | 12/1967 | Caretto | 200/61.08 |
| 3,423,547 | A | * | 1/1969 | Caretto | 200/61.08 |
| 3,715,743 | A | * | 2/1973 | Denton | 340/303 |
| 4,280,120 | A | * | 7/1981 | Trafford et al. | 340/303 |
| 4,551,707 | A | * | 11/1985 | Simpson | 340/287 |
| 4,857,679 | A | * | 8/1989 | Bennett et al. | 200/61.62 |

FOREIGN PATENT DOCUMENTS

| | | | | |
|---|---|---|---|---|
| EP | 0065826 | | 12/1982 | |
| EP | 0510917 | | 10/1992 | |
| EP | 0592925 | | 4/1994 | |
| GB | 1574703 | A * | 9/1980 | H01H/9/02 |
| GB | 2075265 | A * | 11/1981 | G08B/17/02 |
| GB | 2112211 | A * | 7/1983 | H01H/13/50 |
| GB | 2370670 | A * | 7/2002 | G08B/17/02 |
| WO | 0111585 | | 2/2001 | |

OTHER PUBLICATIONS

U.S. 2,545,854 abstract for "Hand Hazard Warning Device".

* cited by examiner

*Primary Examiner*—Anatoly Vortman
(74) *Attorney, Agent, or Firm*—Baker Botts LLP

(57) ABSTRACT

A manual call point having a housing base (1), a cover and an alarm insert with a fragile panel (4), a printed-circuit board (3), a switching element (6) and an actuating mechanism. The actuating mechanism for the switching element (6) is formed by a pivoting lever (7) resting on a lateral edge of the panel (4), the pivoting lever (7) pressing on the switching element (6) in the normal state of the manual call point and holding the switching element (6) in a closed position. When the panel (4) is smashed the pivoting lever (7) pivots, so the switching element (6) is opened. The switching element (6) is arranged on the printed-circuit board (3) and comprises a flexible end switch. The manual call point also contains a device for triggering a test alarm comprising a switching lever (9) to displace the panel (4) until the pivoting lever (7) is released and comprises a member (10) to actuate the switching lever (9).

8 Claims, 1 Drawing Sheet

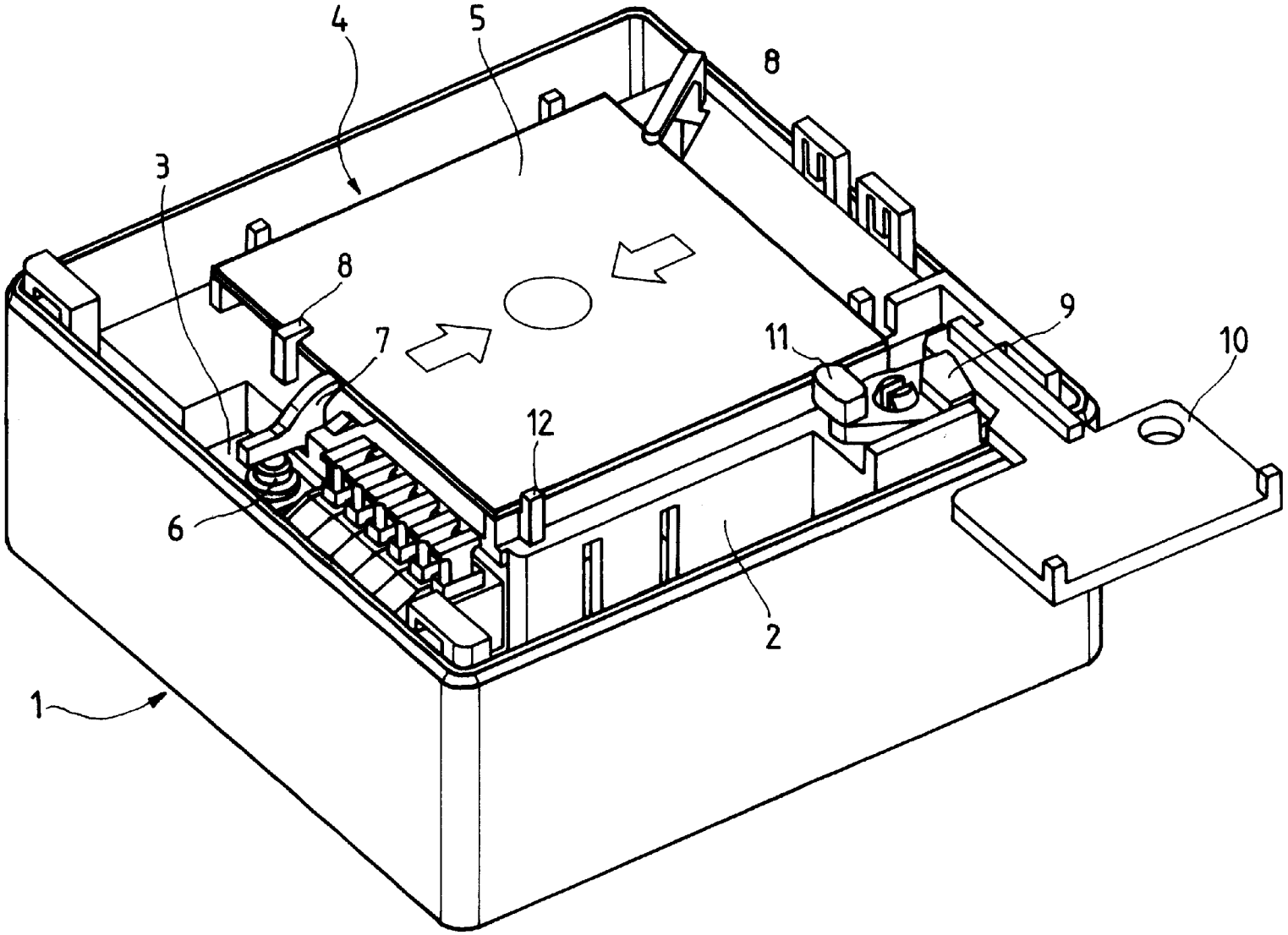
10
9
8
11
2
5
12
4
7
8
3
6
1

MANUAL CALL POINT

The present invention relates to a manual call point with a housing base, a cover and an alarm insert comprising a fragile panel, a printed-circuit board, a switching element and an actuating mechanism for the latter.

BACKGROUND OF THE INVENTION

Manual call points are used, for example, in fire alarm equipment or emergency telephones and are conventionally produced in two designs for direct and indirect actuation. In the alarm type with indirect actuation, the panel is to be smashed and a push button pressed. In the alarm type with direct actuation, which is substantially more common nowadays, when the panel is smashed a spring button jumps out as a result of spring pressure and in the process actuates a switch button of the switching element.

In a known manual call point of the latter type with a bevelled switching gate, the spring button is extended by a resilient rod which rests on the glass panel and holds the spring button in the pressed-down position, so the switch button is held in the ready position. To sound the alarm when the panel is smashed, the spring button is pressed out by the compression spring and the switch button is released to trigger the alarm signal. This embodiment is very expensive from a mechanical point of view, in particular due to the configuration of the spring button with the resilient rod. Moreover, relatively narrow tolerances must be adhered to, and therefore this embodiment is costly to produce.

EP-A-0 592 925 describes a manual call point in which the spring button is fastened to an operating lever and together therewith is pressed by a compression spring against the glass panel. The operating lever is rotatably fixed at one end and at the other end has a resilient element which presses on a switch button when the glass panel is smashed. In this manual call point the switch button is not in the ready position in the normal state, so it is not possible to control precise functioning of the alarm from the control center. Instead, each alarm must be controlled in situ which certainly does not simplify the operation and service of an alarm system equipped with these alarms. Furthermore, the construction of the manual call point and its actuating mechanism formed from the operating lever, the spring button, the compression spring and the resilient element are not optimal from the point of view of economical manufacture.

SUMMARY OF THE INVENTION

The present invention provides a manual call point of the type mentioned at the outset, the capacity to function and readiness of which can be monitored from the control center, and which has a simple construction and can be produced economically. Accordingly, the operating mechanism for the switching element is formed by a pivoting lever resting on a lateral edge of a panel, which in the normal operating state of the manual call point presses on the switching element and holds this in a closed position.

In a preferred embodiment of the manual call point according to the present invention, when the panel is smashed, the pivoting lever pivots which opens the switching element which in the normal state is always switched on and can therefore easily be monitored in terms of its capacity to function from a control center. Use of the pivoting member as an actuating mechanism simplifies this enormously, so both the material and the production costs are considerably reduced.

In another preferred embodiment of the present invention, the switching element is arranged on a printed-circuit board. This arrangement contributes to a reduction in the production costs since the switching element is applied to the printed-circuit board when it is fitted, thereby eliminating expensive subsequent installations.

Yet another preferred embodiment of the manual call point according to the present invention the pivoting lever is designed with two arms. One end rests on the panel and the other end presses on the switching element which preferably has a sprung end switch. In this configuration, with the pivoting lever being arranged on the edge of the panel makes the actuating mechanism very strong with regard to tolerance differences, dust and other potential sources of disturbance.

In a further preferred embodiment of the present invention, a device is provided to trigger a test alarm. This device comprises a switching lever to displace the panel until the pivoting lever is released, and a key to actuate the switching lever.

In still another preferred embodiment of the present invention the aforesaid key can be inserted into the alarm from below such that in a first insertion position of the key the switching lever is unlocked, and upon further insertion of the key into a second insertion position the panel is displaced. The switching lever preferably has a positioning digit which in the locked position of the switching lever rests on the adjacent lateral edge of the panel, and upon further insertion of the key moves away from said lateral edge, pivoting the panel and releasing the pivotal lever.

BRIEF DESCRIPTION OF THE DRAWINGS

The present invention is described in detail below in connection with FIG. 1 which shows a schematic perspective view from the front of a manual call point according to the invention.

DETAILED DESCRIPTION OF THE INVENTION

According to the present invention, the manual call point consists of a housing base 1, a cover (not shown) and an alarm insert comprising a side wall 2, a printed-circuit board 3, a fragile panel 4 held at a distance from the printed-circuit board 3 and having a printed protective film 5, a switch element 6 comprising a sprung-end switch and an actuating mechanism for the switch which serves to actuate the switching element 6 and trigger an alarm when the panel 4 is smashed.

The actuating mechanism is formed by a two-armed pivoting lever 7 which rests at one end on a lateral edge of the panel 4, with the other end pressing the end of the switching element 6, so that when the panel 4 is intact the switch formed by the switching element 6 is closed. The cover, which is not shown, is placed on the housing base 1 and fixed thereto and contains an edge surrounding the panel 4 and an aperture defined thereby, so that the panel 4 is freely accessible. The panel 4 rests on edge strips provided in the alarm insert and is fixed by two holding digits to the alarm insert. This has the advantage that when an alarm system is installed, the alarm housing and alarm insert can be delivered separately with the alarm insert being fitted into the already installed housing. One of the two holding digits 8 may be designed to pivot in order to facilitate insertion of the panel 4.

When the panel 4 is smashed, it splits along a line of arrows printed on the film 5 and is pressed inward in this region. The upper end of the pivoting lever 7 is thus released by the lateral edge resting on it when the panel 4 has not been destroyed. The pivoting lever therefore performs a pivoting movement in the clockwise direction and releases the sprung end-switch of the switching element 6, thereby the alarm triggering.

As shown in FIG. 1, the manual call point according to the present invention is equipped with a device to trigger a test alarm. This consists of a switching lever 9 to displace the panel 4 into a position in which the pivoting lever 7 is released, and a key 10 which actuates the switching lever 9. The switching lever 9 comprises a positioning digit 11 which rests on the adjacent lateral edge of the panel 4, and is locked in its normal position. The housing base 1 further comprises a groove-like guide for insertion of the key 10. The guide is accessible through a corresponding aperture in the lower lateral wall of the cover. Upon insertion of the key 10, the switching lever 9 is unlocked and released in a first key position. The switch lever 9 is rotated into a second position together with a positioning digit 11 upon further insertion of the key 10. The panel 4 is therefore released and tilts around a pin 12 acting as a pivot, so the edge of the panel 4 resting on the pivoting lever 7 is moved away from the front end of the pivoting lever 7, which releases it, so that the switching button of the switching element 6 is released and the alarm is triggered. When the key 10 is withdrawn the panel 4 is pivoted by the positioning digit 11 back into its normal operating position and is then fixed therein.

We claim:

1. A manual call point comprising a housing base and an alarm insert which comprises a fragile panel, a printed-circuit board, a switching element and an actuating mechanism, wherein the actuating mechanism for the switching element is formed by a pivoting lever which rests on a lateral edge of the panel which in a normal operating state of the manual call point presses on the switching element and holds the switching element in a closed position.

2. The manual call point according to claim 1, wherein when the panel is smashed the pivoting lever pivots, so the switching element is opened.

3. The manual call point according to claim 1, wherein the switching element is located on the printed-circuit board.

4. The manual call point according to claim 1, wherein the pivoting lever has two arms and at one end rests on the panel and at its other end presses on the switching element (6).

5. The manual call point according to claim 4, wherein the switching element comprises a sprung-end switch.

6. The manual call point according to claim 1, wherein a device for triggering a test alarm, comprises a switching element to displace the panel until the pivoting lever is released, and a key to actuate the switching element.

7. The manual call point according to claim 6, wherein the key is inserted into the alarm from below, and the switching element is unlocked in a first insertion position of the key and upon insertion of the key into a second insertion position the panel is displaced.

8. The manual call point according to claim 6, wherein the switching element comprises a positioning digit resting on an adjacent lateral edge of the panel in a locked position of the switching element and which upon insertion of the key to a desired position is moved away from said lateral edge, thereby the panel causing to pivot and the pivoting lever to release.

* * * * *